US011333301B2

(12) United States Patent
Saad et al.

(10) Patent No.: US 11,333,301 B2
(45) Date of Patent: May 17, 2022

(54) PRESSURE VESSEL FOR THE STORAGE OF PRESSURIZED FLUIDS AND VEHICLE COMPRISING SUCH A PRESSURE VESSEL

(71) Applicant: Advanced Lightweight Engineering B.V., Rotterdam (NL)

(72) Inventors: Faris Saad, Alphen aan den Rijn (NL); Jan Jacobus Matthijs Koppert, Rotterdam (NL)

(73) Assignee: Advanced Lightweight Engineering B.V., Rotterdam (NL)

( * ) Notice: Subject to any disclaimer, the term of this patent is extended or adjusted under 35 U.S.C. 154(b) by 81 days.

(21) Appl. No.: 16/613,791

(22) PCT Filed: May 15, 2018

(86) PCT No.: PCT/NL2018/050319
§ 371 (c)(1),
(2) Date: Nov. 14, 2019

(87) PCT Pub. No.: WO2018/212647
PCT Pub. Date: Nov. 22, 2018

(65) Prior Publication Data

US 2021/0148512 A1 May 20, 2021

(30) Foreign Application Priority Data

May 15, 2017 (NL) ..... 2018919

(51) Int. Cl.
*F17C 1/06* (2006.01)
*F17C 1/12* (2006.01)

(52) U.S. Cl.
CPC ..... *F17C 1/06* (2013.01); *F17C 1/12* (2013.01); *F17C 2201/0109* (2013.01);
(Continued)

(58) Field of Classification Search
CPC ..... F17C 1/06; F17C 1/12; F17C 2201/0109; F17C 2201/0152; F17C 2201/0166;
(Continued)

(56) References Cited

U.S. PATENT DOCUMENTS 2,294,858 A 9/1942 Allen
2,541,065 A 2/1951 Labour
(Continued)

FOREIGN PATENT DOCUMENTS

CN 1074281 A 7/1993
CN 1419642 A 5/2003
(Continued)

OTHER PUBLICATIONS

International Search Report from PCT/NL2010/050804, dated Apr. 28, 2011.
(Continued)

*Primary Examiner* — Stephen J Castellano
(74) *Attorney, Agent, or Firm* — Adsero IP

(57) ABSTRACT

A pressure vessel and a system of a vehicle with such a pressure vessel, wherein the pressure vessel is suitable for storage of pressurized fluids, comprising a housing which extends along a longitudinal axis. The housing defines an inner volume. The shape of the housing, in longitudinal cross-section, is defined by the circumference of a set of circles. The set of circles comprises a central circle, with a center point which is defined by the longitudinal axis, and four primary peripheral circles each of which intersects with the central circle at two points. The primary peripheral circles are axially distributed on the central circle in opposing pairs.

16 Claims, 11 Drawing Sheets

(52) U.S. Cl.
CPC ..... *F17C 2201/0152* (2013.01); *F17C 2201/0166* (2013.01); *F17C 2201/0171* (2013.01); *F17C 2201/035* (2013.01); *F17C 2203/0325* (2013.01); *F17C 2203/0333* (2013.01); *F17C 2203/0391* (2013.01); *F17C 2203/0621* (2013.01); *F17C 2203/0663* (2013.01); *F17C 2221/033* (2013.01); *F17C 2221/035* (2013.01); *F17C 2270/0105* (2013.01); *F17C 2270/0171* (2013.01); *F17C 2270/0178* (2013.01)

(58) Field of Classification Search
CPC ..... F17C 2201/0171; F17C 2201/035; F17C 2203/0621; F17C 2203/0663; F17C 2270/0105
See application file for complete search history.

(56) References Cited

U.S. PATENT DOCUMENTS

| | | | | |
|---|---|---|---|---|
| 2,858,992 | A | 11/1958 | Wentz | |
| 3,047,191 | A | 7/1962 | Young | |
| 3,184,092 | A | 5/1965 | George | |
| 3,207,352 | A | 9/1965 | Reinhart, Jr. | |
| 3,228,549 | A | 1/1966 | Courtney | |
| 3,414,153 | A | 12/1968 | Leroux | |
| D213,249 | S | 1/1969 | Winegardner | |
| 3,448,253 | A | 6/1969 | Bramblett | |
| 4,785,956 | A | 11/1988 | Kepler | |
| D306,639 | S | 3/1990 | Wills | |
| 5,287,987 | A | 2/1994 | Gaiser | |
| 5,499,739 | A | 3/1996 | Greist, III | |
| 5,526,994 | A | 6/1996 | Murphy | |
| 5,822,838 | A | 10/1998 | Seal | |
| 6,095,367 | A | 8/2000 | Blair | |
| 6,176,386 | B1 | 1/2001 | Beukers | |
| 6,357,439 | B1 | 3/2002 | Cook | |
| 7,086,553 | B2 | 8/2006 | Debecker | |
| 7,219,812 | B2 | 5/2007 | Debecker | |
| D566,807 | S | 4/2008 | Oliveira | |
| 8,863,977 | B2 | 10/2014 | Koppert | |
| 2004/0045970 | A1 | 3/2004 | Debecker | |
| 2006/0151506 | A1 | 7/2006 | Koppert | |
| 2009/0050635 | A1* | 2/2009 | Richards | F17C 1/14 220/584 |
| 2009/0255940 | A1 | 10/2009 | Murate et al. | |
| 2015/0336680 | A1 | 11/2015 | Schumacher | |
| 2015/0362125 | A1* | 12/2015 | Morales | F17C 1/06 220/4.12 |

FOREIGN PATENT DOCUMENTS

| | | | |
|---|---|---|---|
| DE | 644147 | | 4/1937 |
| DE | 19631546 | C1 | 11/1977 |
| FR | 1254987 | | 3/1961 |
| FR | 2046002 | | 3/1971 |
| FR | 2781555 | | 1/2000 |
| GB | 703811 | | 1/1952 |
| JP | 10119138 | A | 5/1998 |
| JP | 2001050494 | | 2/2001 |
| WO | WO 1997/012175 | | 4/1997 |
| WO | WO 1997/017570 | | 5/1997 |
| WO | WO 2007/079971 | | 7/2007 |
| WO | WO 2010/091062 | | 8/2010 |

OTHER PUBLICATIONS

International Search Report from PCT/NL2018/050319, dated Sep. 17, 2018.
Koppert & Beukers (2000) SAMPE Journal 36(6):8-15, "Full Composite Isotensoid Pressure Vessels or How Composites Can Compete with Steel".
Patent Abstracts of Japan (May 1998) vol. 1998, No. 10, Publication No. 10119138 A.
Rosato & Grove (1964) Polymer Engineering and Technology p. 216-233, 270-271, "Filiament Winding: it's development, manufacture, applications and design".
Search Report from CN 201080071150.1 dated Apr. 22, 2014 (in English).

* cited by examiner

A-A

PRESSURE VESSEL FOR THE STORAGE OF PRESSURIZED FLUIDS AND VEHICLE COMPRISING SUCH A PRESSURE VESSEL

RELATED APPLICATIONS

This application is a 35 U.S.C. § 371 national phase application of PCT/NL2018/050319 (WO 2018/212647), filed on May 15, 2018, entitled "Pressure Vessel for the Storage of Pressurized Fluids and Vehicle Comprising Such a Pressure Vessel", which application claims the priority to Netherlands Application No. 2018919, filed May 15, 2017, which is incorporated herein by reference in its entirety.

A pressure vessel for storage of pressurized fluids, comprising a housing which extends along a longitudinal axis, wherein the housing defines an inner volume.

In the state of the art cylindrical pressure vessels are known. Such pressure vessels can be found as fuel tanks on heavy duty vehicles, such as trucks and busses, but they can also be found as general transport or storage vessels. Typically, these pressure vessels are arranged to carry fuels, such as liquefied natural gas (LNG), and liquefied petroleum gas (LPG). Smaller vehicles, such as cars, are also known to carry pressure vessels for LPG. Typically the internal volumes of such vessels vary between 10 $dm^3$-100 $dm^3$. Fuel tanks may also be larger than 100 $dm^3$ depending on the fuel requirement of a vehicle or when considering bulk transport or even maritime tank vessels (>1000 m3). When considering bulk transport the typical volume is equal to that of a tank container built to the standard dimensions of a ISO or intermodal container. Such a tank container is typically a cylindrical pressure vessel which may be mounted in a rectangular steel framework fitting the ISO or intermodal cubic dimensions. Beside fuels, such pressure vessels may also be used to carry and store other pressurized fluids, such as cryogenic liquids, in particular liquid Nitrogen.

LNG and LPG vehicles are often adapted from pre-existing diesel or petrol vehicles to use liquefied fuels. These pre-existing vehicles were often designed for carrying a fuel tank which has cubic dimensions. Accordingly, the available space for a pressure vessel fuel tank is often also cubic in shape. A problem is that current cylindrical pressure vessels, which fit within such a cubic shape may not effectively make use of a substantial portion of the available space. This means that a refurbished LNG or LPG vehicle would not be able to carry the same volume of liquefied fuel in a pressure vessel compared to its previous diesel or petrol fuel tank. In many cases this reduces the action radius of an LNG or LPG refurbished vehicle. Such unused available volume is also a problem when considering the storage and transport of any other liquefied fluid in a cylindrical pressure vessel. Such unused available volume is also an issue in tank trucks or tank trailers, and tank containers, wherein cylindrical pressurized containers are used to fit the ISO or intermodal cubic dimensions, as well in maritime gas tankers.

The invention aims to provide a pressure vessel and a vehicle comprising such a pressure vessel. The invention aims to mitigate at least some of the above mentioned drawbacks. To this end according to a first aspect of the invention the pressure vessel according to the invention is characterized in that, the shape of the housing, in longitudinal cross-section, is defined by the circumference of a set of circles. The set of circles comprises a central circle, with a center point which is defined by the longitudinal axis, and four primary peripheral circles each of which intersects with the central circle at two points. The primary peripheral circles are axially distributed on the central circle in opposing pairs. It will be understood that the housing is suitable for receiving and holding therein a pressurized fluid. The housing may be a steel housing, such as stainless steel.

Optionally, the housing shape has an inner surface area to volume ratio which is lower than that of a comparative housing of rectangular cuboid shape having a volume which is consistent with a length, height and width of the housing. A benefit is that the housing is more resistant to material fatigue compared to its rectangular cuboid counterpart. It should be understood that the inner-surface radial stress is lower for the housing according to the invention with respect to a comparative rectangular cuboid housing with a same housing thickness.

Preferably the radius of each of the primary peripheral circles is smaller than a radius of the central circle. This is beneficial to the structural integrity of the pressure vessel.

Preferably the housing is tetradically symmetrical. The housing is tetradically symmetrical in that the set of circles is arranged such that the opposing pairs of primary peripheral circles are axially offset by 90 degree angles with respect to one another around the center point. A benefit is that this allows the internal pressure to be distributed across the inner surface more evenly. Thus improving structural integrity and allowing the thickness of the housing to be reduced.

Optionally the set of circles further comprises four secondary peripheral circles. Each of the secondary peripheral circles intersects with a mutually different primary peripheral circle at two further points. Each of the secondary peripheral circles is arranged in line with an outward direction from the central circle to the primary peripheral circle with which said secondary peripheral circle intersects. The radius of the secondary peripheral circles is smaller than the radius of the primary peripheral circles.

Optionally the housing is provided with a first support structure for each primary peripheral circle, wherein, in longitudinal cross-section of the housing, the first support structure connects the two points of intersection, corresponding to a respective primary peripheral circle and central circle. This secures the areas of intersection against moving outward under influence of internal pressure in the housing.

Preferably the first support structure is formed by an elongated plate. It will be understood that the plate extends in a longitudinal direction parallel to the longitudinal axis. The elongated plate is connected to an inner surface of the housing along its longitudinal edges. The plate can be connected to the inner surface of the housing by means of a weld. This reduces the seams or points of intersection in the housing as points of weakness. The first support structure is provided with at least one through hole which extend from an inner face towards an outer face of the first support structure. Preferably the at least one through hole comprises a plurality of through holes which are spaced along the length of the first support structure at intervals of equal distance. This reduces unnecessary weight of the housing without compromising the structural integrity. Additionally, this prevents the support structure from impeding fluid access to and from the extremities of the housing.

Optionally the housing is provided with a second support structure for each secondary peripheral circle. In the longitudinal cross-section of the housing, the second support structure connects the two further points of intersection, corresponding to a respective secondary peripheral circle and a respective primary peripheral circle.

Optionally the second support structure is formed by an elongated plate. The elongated plate is connected to an inner surface of the housing along its longitudinal edges, and the second support structure is provided with at least one further through hole which extend from an inner face towards an outer face of the second support structure. Preferably the at least one further through hole comprises a plurality of further through holes which are spaced at intervals of equal distance along the length of the second support structure.

Optionally, the pressure vessel comprises a reinforcement which is provided around the housing. This may prevent the housing of the pressure vessel from being deformed under the influence of outside forces.

Optionally, the reinforcement is a filament-wound reinforcement, such as a carbon fiber, an aramid fiber, or a thermoplastic fiber.

Optionally, the housing is shaped such that, in longitudinal cross-section, the housing fits within a square shape. The square shape has a width equal to a diameter of the central circle. Preferably the square shape has corners which are rounded such that each of these corners follows a curvature of a respective extremity of the set of circles, and wherein the reinforcement is provided around the housing in such a manner that, in longitudinal cross-sectional, the reinforcement follows the square shape. This would allow a reinforcement to equally support each of the weakest areas of the housing, namely the extremities.

Optionally, a gap between the reinforcement and the housing is provided with a thermal insulation material, such as aerogel or polyurethane foam. If the reinforcement follows a curvature of the extremities of the set of circles, such as primary or secondary peripheral circles, a combination benefit is that the insulation material in the gap will specifically seal heat leaks at the seam, where it is, in case of cryogenic fluids, most needed.

Optionally, the reinforcement is provided as a double wall, wherein the double wall encloses a thermal insulation layer, such as an aerogel, polyurethane foam or a vacuum.

According to a further aspect of the invention a vehicle is provided comprising or provided with a pressure as discussed above.

The invention will be further elucidated on the basis of a non limiting exemplary embodiment, which is represented in the drawings. In the drawings.

It is noted that the drawings are only schematic representations of a preferred embodiment of the invention. In the drawings, identical or corresponding parts are represented with the same reference numerals.

Figure 1:
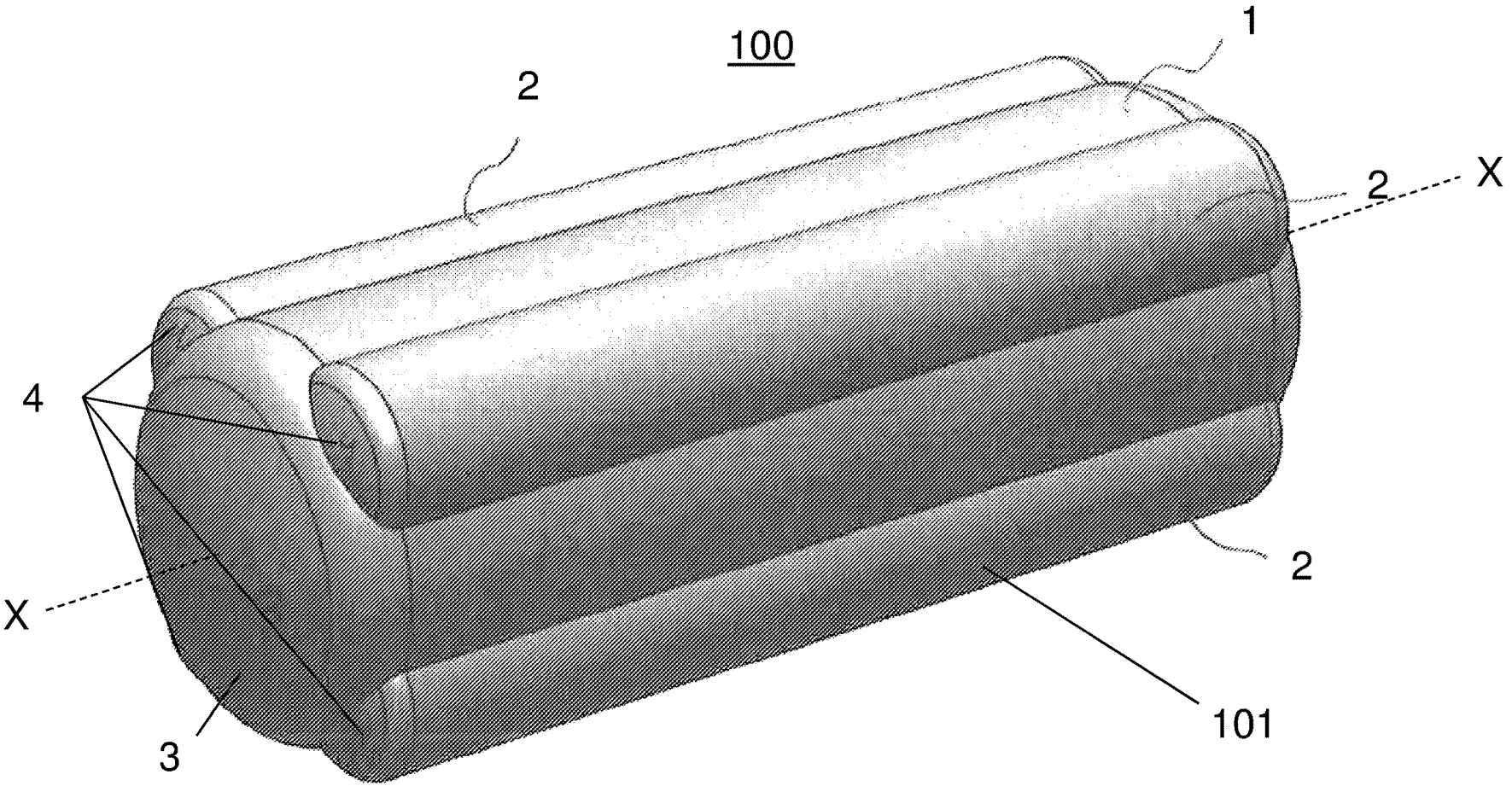
FIG. 1 shows a perspective view of a pressure vessel according to the invention.
Figure 2:
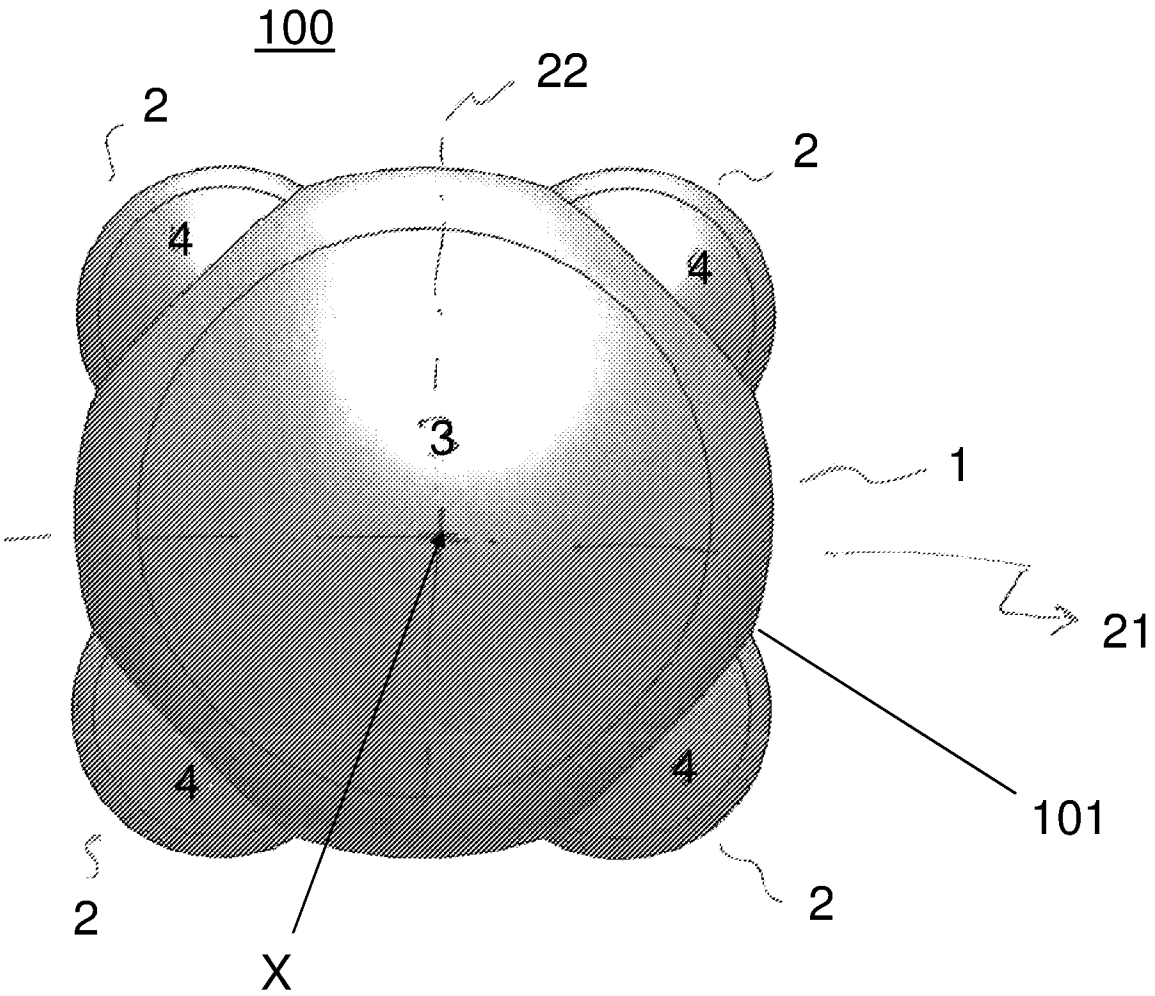
FIG. 2 shows a front view of the pressure vessel according to FIG. 1.
Figure 3:
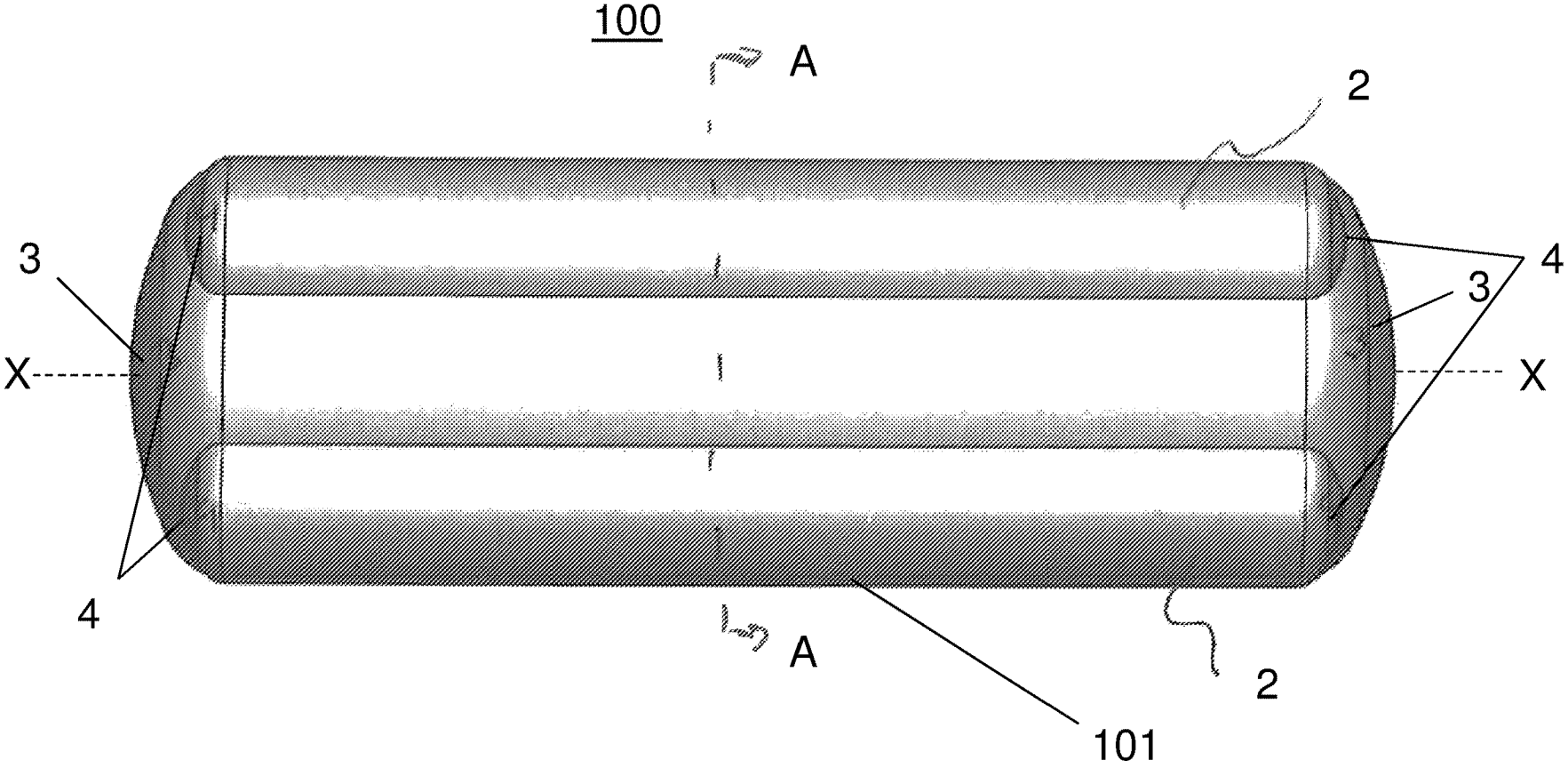
FIG. 3 shows a side view of the pressure vessel according to FIG. 1.
Figure 4:
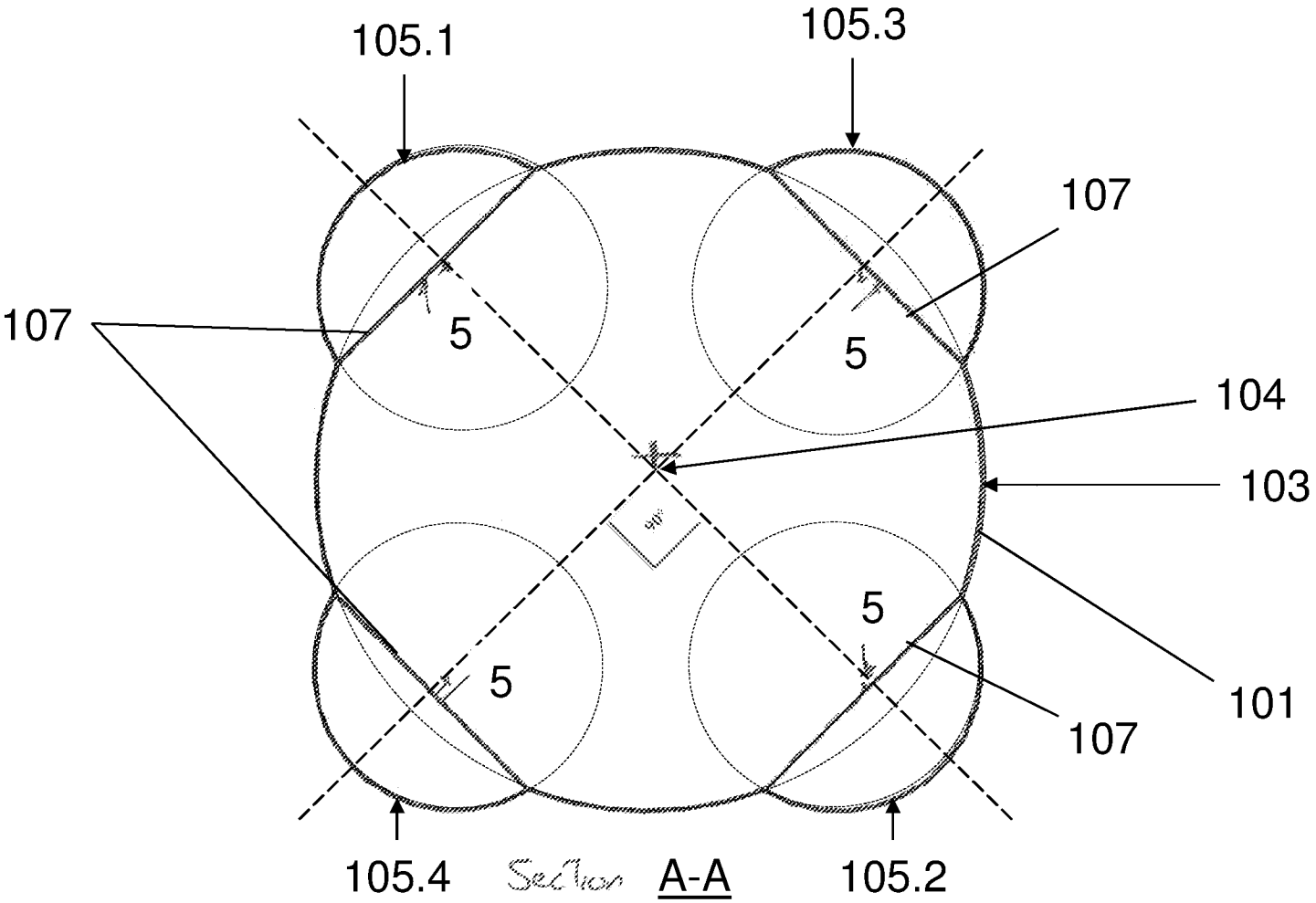
FIG. 4 shows a longitudinal cross-sectional A-A according to FIG. 3.

FIG. 1 shows a perspective view of a pressure vessel 100 according to the invention. The pressure vessel has a housing 101 which defines an inner volume for the storage of pressurized fluids, in this example LPG. The housing is a stainless steel housing. In this example the housing defines a volume of 50 $m^3$ in size and is designed to handle a pressure of 1.77 MPa at a temperature in the range of −20° C. and +54° C. The housing 101 has a wall thickness of 14-16 mm. The housing is fitted with a valve (not shown, but customary) through which the pressurized fluid can be added to or removed from the inner volume. The housing 101 extends along a longitudinal axis X as can also be seen from FIG. 2. The shape of the housing 101, in longitudinal cross-section A-A as taken from the vessel 100 in FIG. 3 and as seen in seen in FIG. 4, is defined by the circumference of a set of imaginary circles 103, 104. This set of circles consists of a central circle 103, with a center point 104 which is defined by the longitudinal axis X, and four primary peripheral circles 105.*i* (i=1, 2, 3, 4) each of which intersects with the central circle 103 at two points. The primary peripheral circles 105.*i* are axially distributed over the circumference of the central circle 103 in opposing pairs 105.1, 105.2 and 105.3, 105.4 which are offset by 90 degrees with respect to each other. In this manner the longitudinal cross-section of the housing is tetradically symmetrical. In this embodiment the radius of each of the primary peripheral circles 105.*i* is smaller than a radius of the central circle 103. However, versions of the housing are also thinkable in which the radius of the primary peripheral circles are the same, or larger than the radius of the central circle. The housing 101 is shaped such that, in longitudinal cross-section, the housing fits within a square shape, wherein the square shape has a width equal to a diameter of the central circle 103.

To this end a pre-made principal cylindrical pressure vessel 1 and two pre-made secondary pressure vessels are be provided, wherein the principle vessel 1 defines the diameter of the central circle 103, and wherein each of the secondary vessels is mutually equal in size and defines the diameter of the primary peripheral circles 105.*i*. In this example all vessels are made of stainless steel with a thickness of 14-16 mm. The secondary vessels are shorter in length then the principle vessel. The principle vessel 1 is provided with four recesses in the form of cut-outs each of which extends in the length direction of the housing. In longitudinal cross-section A-A, the cut-outs have a width that is less than the diameter of the secondary vessels and the cut-outs are axially distributed around an outer surface of the principle vessel 1 such that one cut-out to the next is distanced equally. The secondary vessels are halved. Each half 2 is further cut to fit a corresponding cut-out. The housing 101, as shown in FIGS. 1-7, is assembled from the principal vessel 1 and the halves 2. To this end the halves 2 are fluid sealingly welded to the primary vessel such that the cut-outs are covered by the halves 2, also called external chambers. Prior to assembly of the housing a first support structure 107, in this example a stainless steel plate, is provided for each half 2. The dimensions of the first support structure 107 is defined by the cut-outs. This first support structure 107 is welded at its peripheral edges to the edges of the principal vessel as defined by a corresponding cut-out area. The support structure is provided with through holes 9 (shown in FIG. 7), also known as communication holes for enabling fluid communication there through. These through holes 9 extend from an inner face of the support structure towards an outer face of the support structure 107. The through holes 9 are spaced at intervals of equal distance along the length of the support structure 107. The principal cylindrical vessel 1 and the external chambers 2 are closed off with the end caps 3 and 4 respectively. All four external chambers 2 are placed equidistant to the center of the principal cylindrical vessel formed by the intersection of a horizontal axis 21 and a vertical axis 22.

Figure 5:
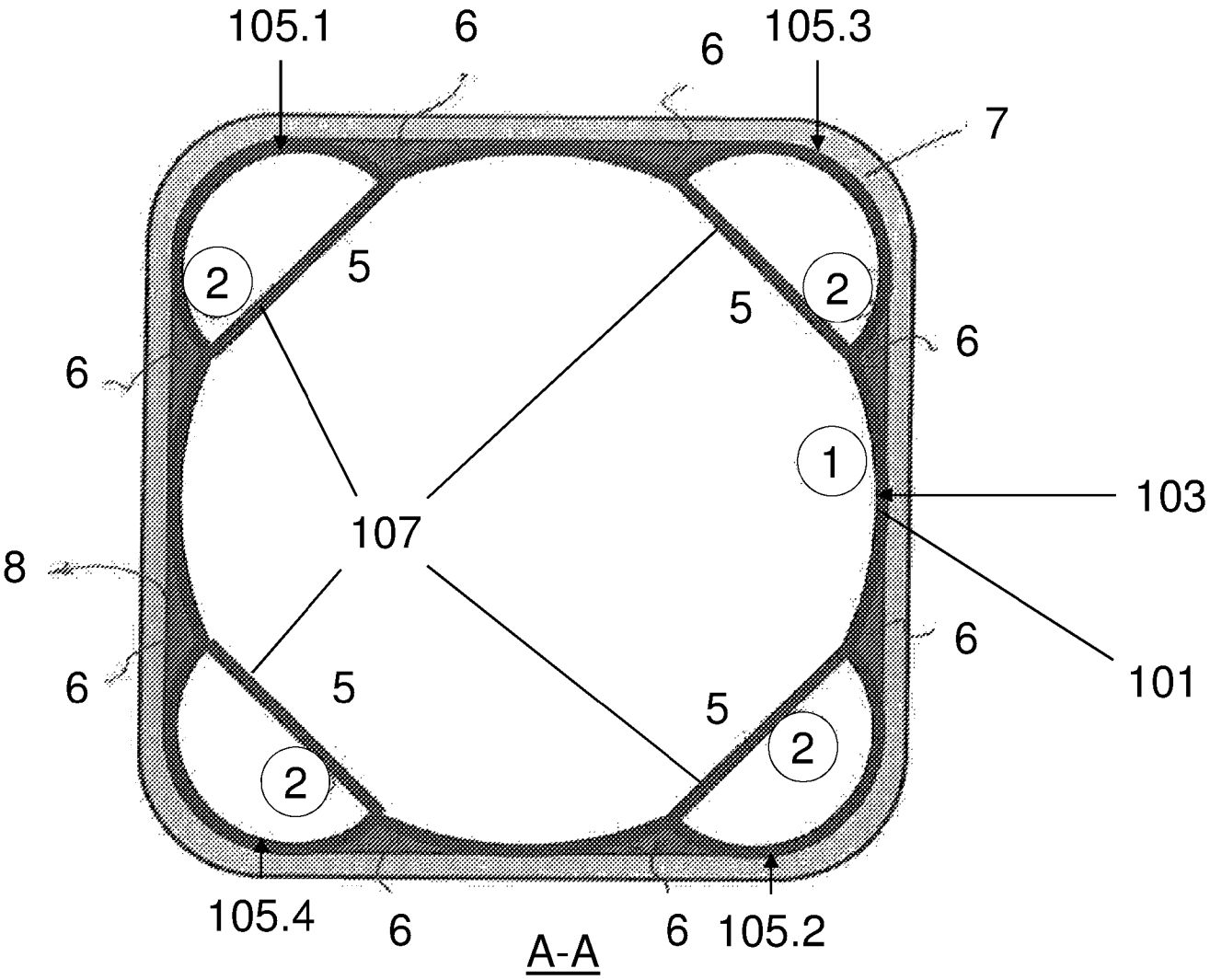
FIG. 5 shows a longitudinal cross-section of a further the pressure vessel according to the invention.
Figure 6:
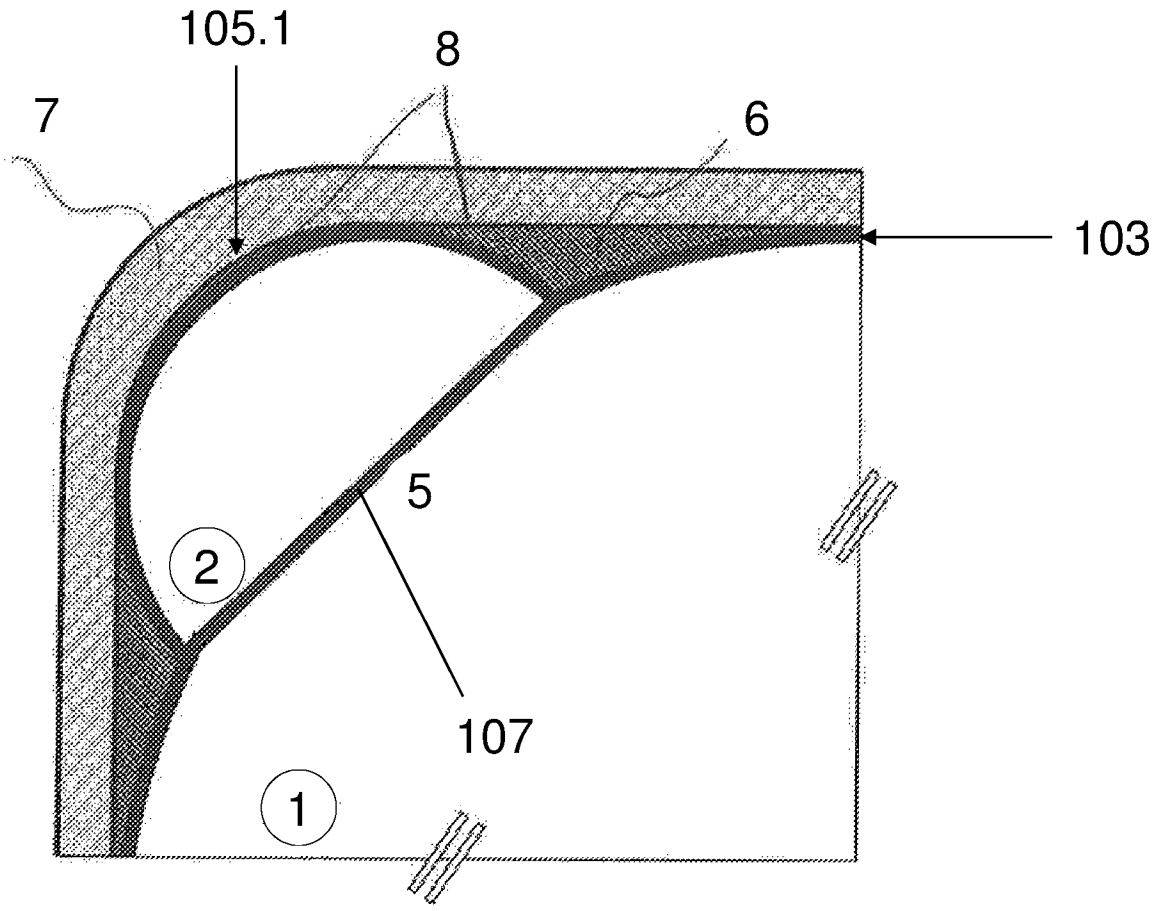
FIG. 6 shows a partial longitudinal cross-section of the pressure vessel according to FIG. 5.

In FIG. 5 the same cross-section A-A is again shown. However, in this example the housing 101 is externally wrapped in a filament-wound reinforcement 8, e.g. a dry wound filament or a filament wound in a wet matrix resin, which follows the curvature of the outer most part of the welded halves 2. In addition or as an alternative, other types of (fiber) reinforcements or coverings may be used. This reinforcement 8 is in this example an aramid fiber, such as Kevlar. A gap 6 between the reinforcement 8 and the housing 101 is provided with a thermal insulation material, such as aerogel or polyurethane foam, but could alternatively also be left empty. The reinforcement 8 is enclosed in a thermal insulation layer 7. In this example the thermal insulation layer 7 is an aerogel, but this could alternatively also be a polyurethane foam or a double wall structure comprising vacuum.

Figure 7:
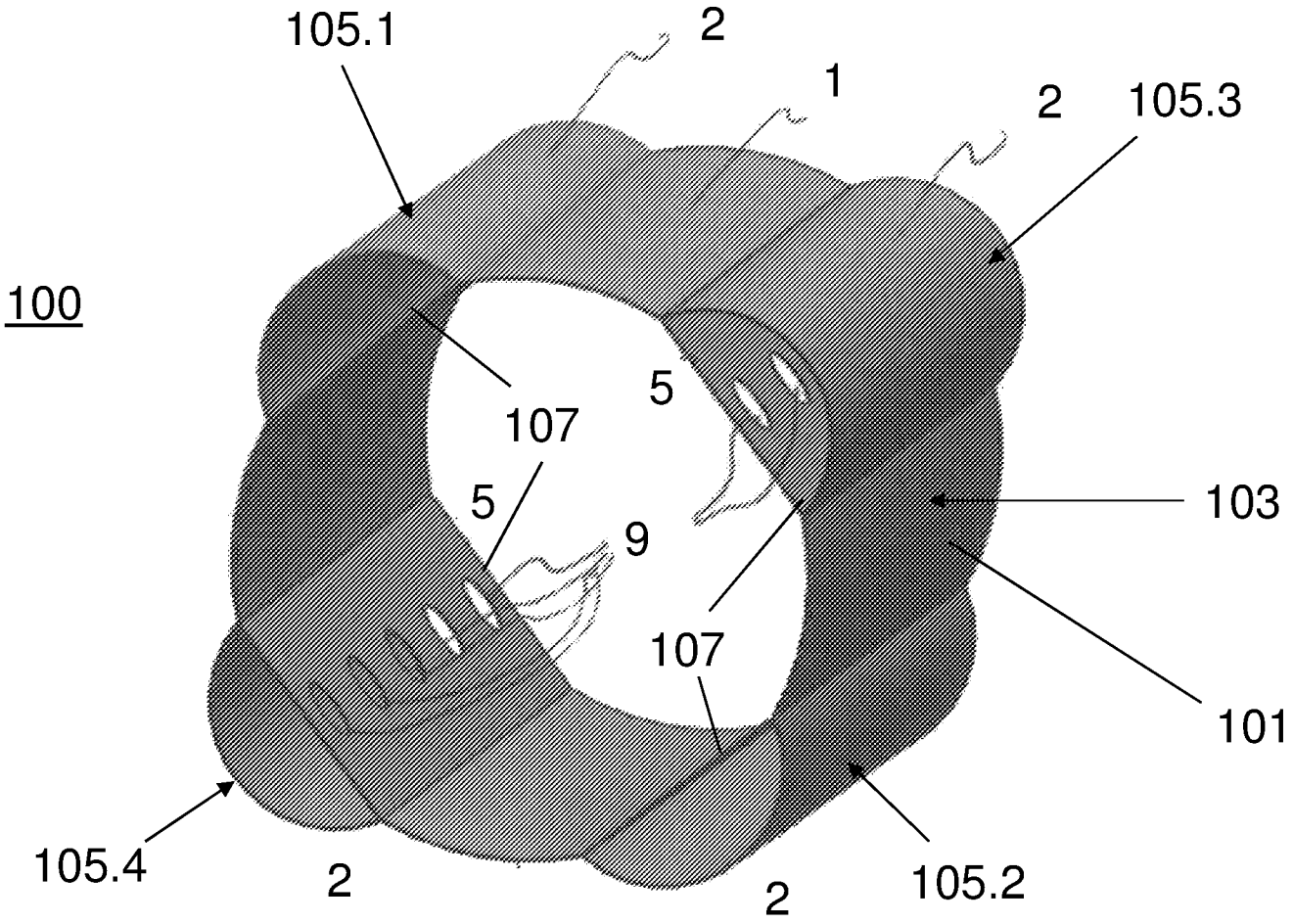
FIG. 7 shows a perspective view of a mid-section of the pressure vessel according to FIG. 1.
Figure 8:
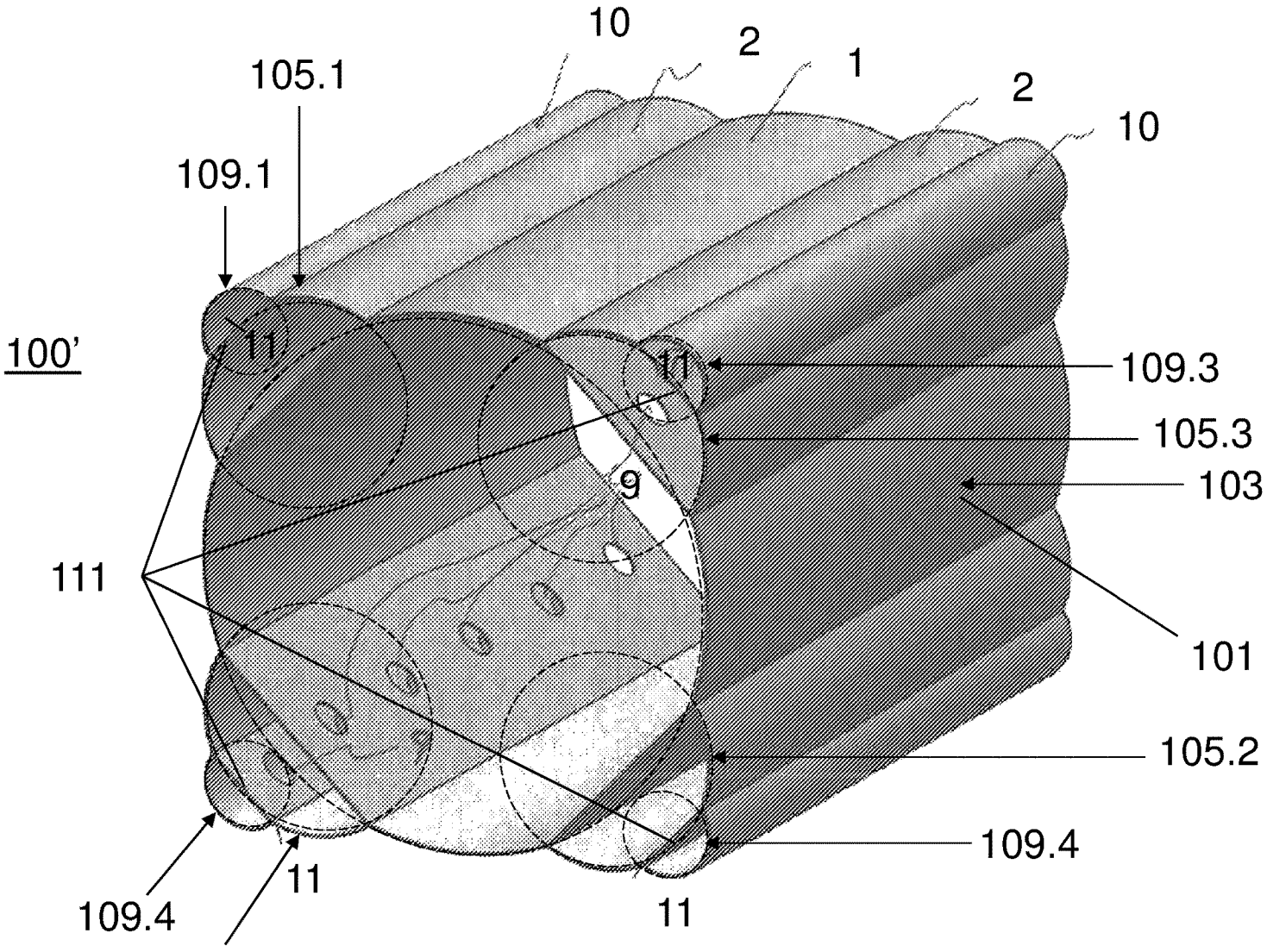
FIG. 8 shows a perspective view of a mid-section of the pressure vessel according to a further pressure vessel according to the invention.

FIG. 8 shows a further embodiment of a pressure vessel 100' according to the current invention which is different from the pressure vessel 100 as shown in FIG. 7. In FIG. 8 features which correspond to features shown in FIGS. 1-7 are referred to using the same reference number. Only differences with the embodiment shown in FIG. 7 will be discussed below. The shape of the housing 101, in longitudinal cross-section, is further also defined by four secondary peripheral circles 109.*i* (i=1, 2, 3, 4). Each secondary peripheral circles 109.*i* intersect with a different one of the corresponding primary peripheral circles 105.*i* at two further points. Each of the secondary peripheral circles 109.*i* is arranged in line with an outward direction from the central circle 103 to the primary peripheral circle 105.*i* with which said secondary peripheral circle 109.*i* intersects. The radius of each of the secondary peripheral circles 109.*i* is smaller than the radius of the primary peripheral circles. The secondary peripheral circles 109.*i* each have a same radius.

To this end the halves 2 are each provided with a further cut-out. These further cut-outs extend in the longitudinal direction of the housing. Two tertiary vessels 10 are also provided. In longitudinal cross-section of the housing 101, the further cut-outs have a width that is less than the diameter of the tertiary vessels and the further cut-outs are positioned at the radially extremities of the housing 101. The tertiary vessels are halved. Each of these additional halves 10 is further cut to fit a corresponding further cut-out. The housing is then further assembled from the additional halves 10. To this end the additional halves 10 are fluid sealingly welded to their corresponding halves 2 such that the further cut-outs are covered by the halves 2. Prior to the further assembly a second support structure 111, in this example a stainless steel plate, is provided for each further half 10. The dimensions of the second support structure 111 is defined by the further cut-outs. Each second support structure 111 is welded at its peripheral edges to the edges of the corresponding halve 2 as defined by a corresponding further cut-out area. The further support structure 111 is also provided with through holes 9. These further through holes 9 however extend from an inner face of the further support structure 111 towards an outer face of the further support structure 111. The through holes 9 are spaced at intervals of equal distance along the length of the further support structure 111.

Figure 9:
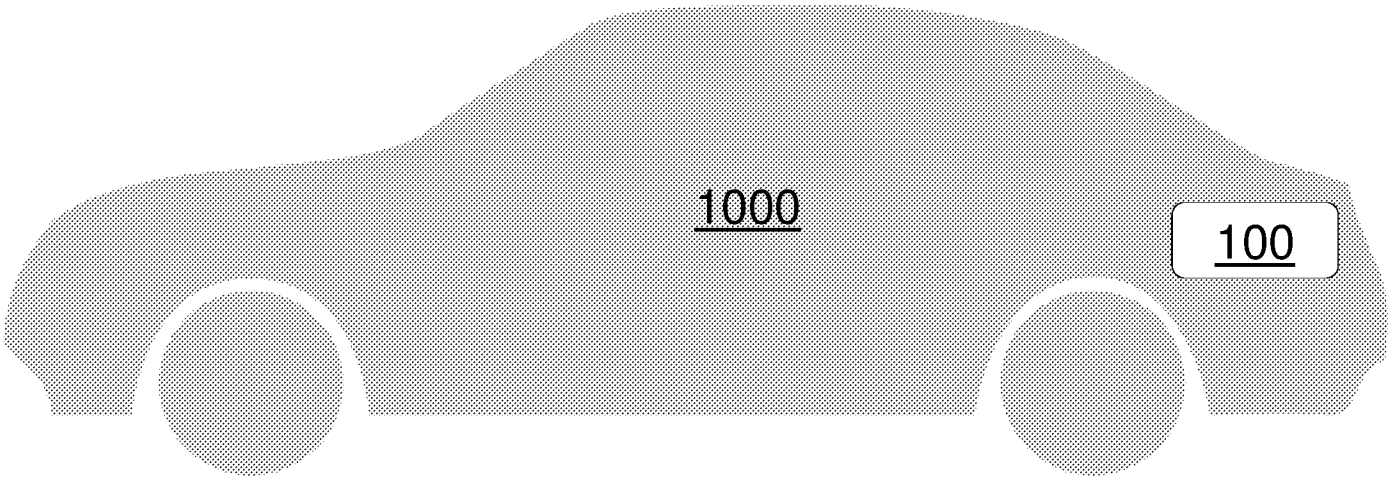
FIG. 9 shows a schematic system of a car and a pressure vessel according to FIG. 5.

FIG. 9 shows a system of a vehicle 1000, in this example a car equipped for LNG or LPG combustion, and the pressure vessel 100 according to FIG. 5. The pressure vessel 100 here takes the place of a known LNG or LPG fuel tank.

Figure 10:
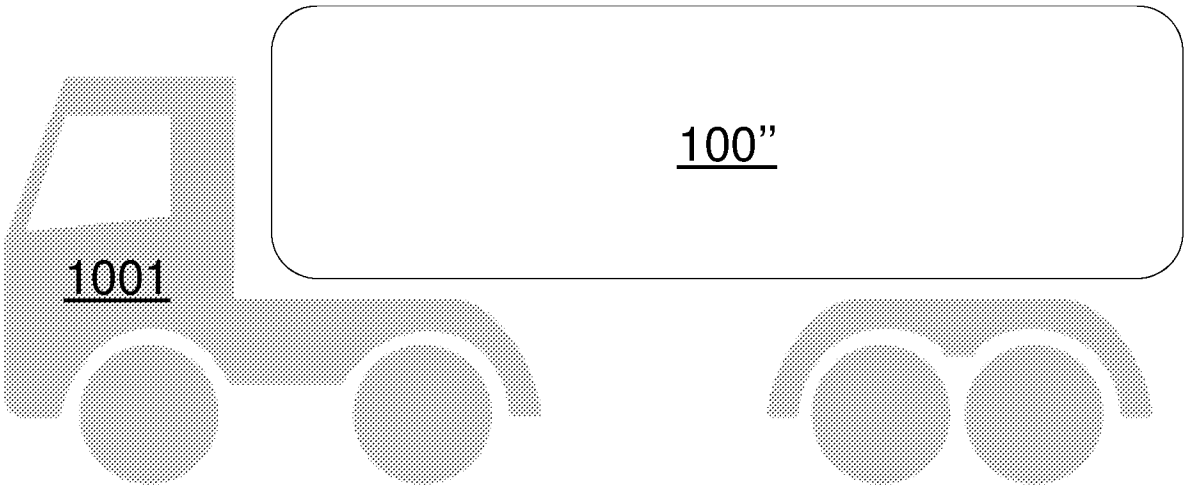
FIG. 10 shows a schematic system of a truck and another pressure vessel according to the invention.

FIG. 10 shows another system of a vehicle, in this example a tank truck 1001 having a tractor and a tanker trailer, and another pressure vessel 100" according to the invention. Only the differences of pressure vessel 100" with respect to pressure vessel 100 as shown in FIG. 1 will be discussed hereafter. The pressure vessel 100" differs from the pressure vessel in FIG. 1 in that it is sized to fill the space available in the cubic dimensions of a standardized intermodal trailer frame, or standardized ISO or tank container, e.g. a rectangular frame having ISO corner fittings. The housing of the vessel 100" has a wall thickness which is chosen in accordance with its size to allow the vessel to carry liquidized fuel, such as LPG or LNG. In case of LNG, the temperature of the liquid in the container may be relatively low, e.g about −165° C. The required wall thickness can be calculated via conventional methods. It will be understood that the pressure vessel 100" can be mounted in a rectangular steel framework, but—can also be embodied as a stand alone pressure vessel, e.g. on a tanker truck, or stationary for storage. The pressure vessel 100" may also be provided with a reinforcement, covering and/or insulation such as previously described in relation to FIG. 5.

Figure 11:
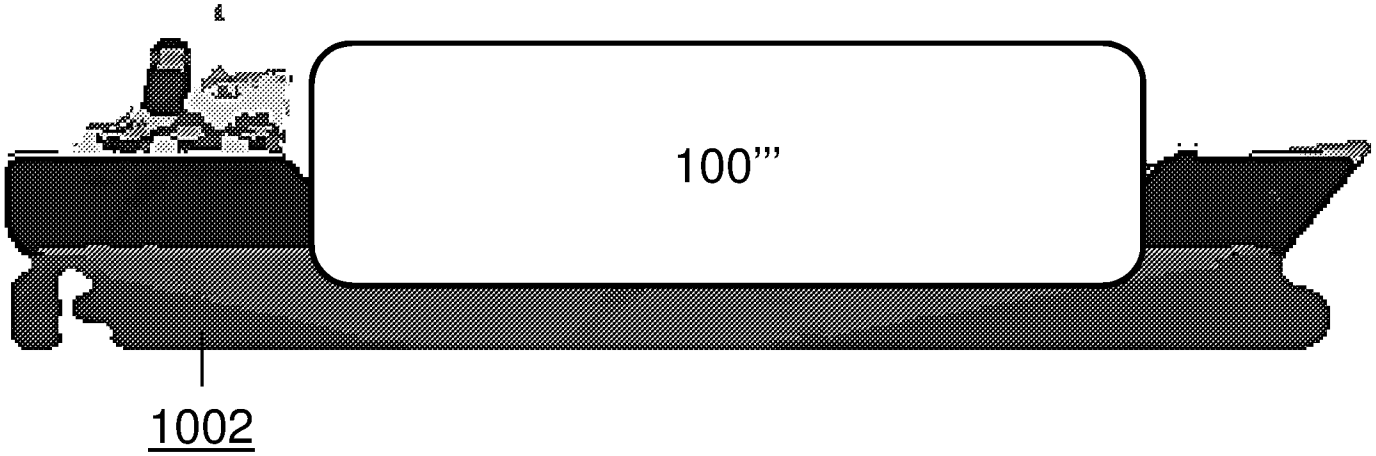
FIG. 11 shows a schematic system of a maritime gas tanker 1002 and yet another pressure vessel 100''' according to the invention.

FIG. 11 shows yet another system of a vehicle, in this example a maritime gas tanker 1002, and another pressure vessel 100''' according to the invention. Only the differences of pressure vessel 100''' with respect to pressure vessel 100 as shown in FIG. 1 will be discussed hereafter. The pressure vessel 100" differs from the pressure vessel in FIG. 1 in that it is sized to for use in maritime bulk transport, in this example 1000 $m^3$ but could also be larger. The vessel may be integrated in the structure of the ship. The housing of the vessel 100''' has a wall thickness which is chosen in accordance with its size to allow the vessel to carry liquidized fuel, such as LPG or LNG. The required wall thickness can be calculated via conventional methods. It will be understood that the pressure vessel 100" can also be seen separate from the system as a stand alone pressure vessel, such as for storage. The pressure vessel 100" may also be provided with a filament-wound reinforcement such as previously shown in FIG. 5.

Accordingly there is described a pressure vessel comprising: a principal cylindrical vessel connected with two pairs of external chambers (up to four in total). The principal cylindrical vessel is described as a container which is able to hold liquids at pressures other than the ambient pressure. This vessel consists of a cylindrical part with two end caps. In order to increase the capacity of the vessel, up to four external chambers are attached to the principal cylinder. The external chambers have a smaller radius than the principal cylinder and are equally radially offset a certain distance from the principal cylinder center. The external chambers consist of a cylindrical central part with two end caps. The chambers are overlapping the principal cylindrical vessel shape. Just the portion of the external chamber that is not overlapping the main cylindrical vessel (i.e. the portion that is outside of the cylindrical vessel diameter) is attached to the principal vessel. The principal cylindrical vessel and the external chamber are sharing a common flattened surface that acts at the same time as a structural beam for increasing the chamber structural strength. The sharing flattened surface between the vessel and the chambers is provided with communication holes for allowing the free flow of the stored fluid in the pressure vessel and for equalizing the pressure among the chambers and the principal cylindrical vessel. In addition, for a further reduction of wall thicknesses of the principal cylindrical vessel and the chambers, the whole pressure vessel can be externally wrapped (circumferential direction) with a filament-wound reinforcement using lightweight materials such as carbon fibres, aramid fibres, thermoplastics or any other materials combination. In order to overcome the inherent problems of maintaining low temperatures for cryogenic applications, the whole pressure vessel may be thermally insulated with a layer of insulation (e.g. aerogel, PU foam or purely vacuum) with a specific designed thickness. The insulation layer may have a structural function. A further extension for this invention includes four additional external chambers with smaller radius overlapping the previous external chambers (now becoming mid-external chambers). The new external chambers share a flattened surface with the mid-external chambers and the flattened surfaces are provided with communication holes for free fluid flow and pressure equilibrium.

As for the scope of this disclosure, it is pointed out that technical features which have been specifically described may be susceptible of a functional generalization. Furthermore, it is pointed out that—as far as not explicitly indicated—such technical features can be seen separately from the context of the given exemplary embodiment, and furthermore can be seen separately from the technical features with which they cooperate in the context of the example.

As for the scope of protection, it is pointed out that the invention is not limited to the exemplary embodiment represented here, and that many variants are possible. Such variants will be clear to the skilled person and are understood to fall within the scope of the invention as set forth in the following claims.

The invention claimed is:

1. A pressure vessel for storage of pressurized fluids, comprising a housing which extends along a longitudinal axis, wherein the housing defines an inner volume, wherein:

the shape of the housing, in longitudinal cross-section, is defined by the circumference of a set of circles, the set of circles comprises a central circle, with a center point which is defined by the longitudinal axis, and four primary peripheral circles each of which intersects with the central circle at two points, the primary peripheral circles are axially distributed on the central circle in opposing pairs, and wherein the set of circles further comprises four secondary peripheral circles, wherein each of the secondary peripheral circles intersects with a mutually different primary peripheral circle at two further points, wherein each of the secondary peripheral circles is arranged in line with an outward direction from the central circle to the primary peripheral circle with which said secondary peripheral circle intersects, and wherein a radius of the secondary peripheral circles is smaller than the radius of the primary peripheral circles.

2. The pressure vessel according to claim 1, wherein a radius of each of the primary peripheral circles is smaller than a radius of the central circle.

3. The pressure vessel according to claim 1, wherein the housing is tetradically symmetrical around the longitudinal axis.

4. The pressure vessel according to claim 1, wherein the housing is provided with a first support structure for each primary peripheral circle, wherein, in longitudinal cross-section of the housing, the first support structure connects the two points of intersection, corresponding to a respective primary peripheral circle and central circle.

5. The pressure vessel according to claim 4, wherein the first support structure is formed by an elongated plate, wherein the elongated plate is connected to an inner surface of the housing along its longitudinal edges, and wherein the first support structure is provided with at least one through hole which extend from an inner face towards an outer face of the first support structure, wherein the at least one through hole comprises a plurality of through holes which are spaced at intervals of equal distance along the length of the first support structure.

6. The pressure vessel according to claim 1, wherein the housing is provided with a second support structure for each secondary peripheral circle, wherein, in the longitudinal cross-section of the housing, the second support structure connects the two further points of intersection, corresponding to a respective secondary peripheral circle and a respective primary peripheral circle, wherein:

the second support structure is formed by an elongated plate, the elongated plate is connected to an inner surface of the housing along its longitudinal edges, and the second support structure is provided with at least one through hole which extend from an inner face towards an outer face of the second support structure, preferably wherein these at least one through hole comprises a plurality of through holes which are spaced at intervals of equal distance along the length of the second support structure.

7. The pressure vessel according to claim 1, comprising a reinforcement which is provided around the housing, wherein the reinforcement is a filament-wound reinforcement.

8. The pressure vessel according to claim 1, comprising a reinforcement which is provided around the housing, the reinforcement is a filament-wound reinforcement.

9. The pressure vessel according to claim 1, wherein the housing is shaped such that, in longitudinal cross-section, the housing fits within a square shape, wherein the square shape has a width equal to a diameter of the central circle.

10. The pressure vessel according to claim 1, comprising a reinforcement which is provided around the housing, wherein the reinforcement is a filament-wound reinforcement, and wherein:

the housing is shaped such that, in longitudinal cross-section, the housing fits within a square shape, wherein the square shape has a width equal to a diameter of the central circle;

the square shape has corners which are rounded such that each of these corners follows a curvature of a respective extremity of the set of circles, and the reinforcement is provided around the housing in such a manner that, in longitudinal cross-sectional, the reinforcement follows the square shape, and wherein a gap between the reinforcement and the housing is provided with a thermal insulation layer.

11. The pressure vessel according to claim 1, comprising a filament-wound reinforcement which is provided around the housing, wherein:

the housing is shaped such that, in longitudinal cross-section, the housing fits within a square shape, the square shape has a width equal to a diameter of the central circle, the square shape has corners which are rounded such that each of these corners follows a curvature of a respective extremity of the set of circles, the reinforcement is provided around the housing in such a manner that, in longitudinal cross-sectional, the reinforcement follows the square shape, with a gap between the reinforcement and the housing provided with a thermal insulation material.

12. The pressure vessel according to claim 1, wherein the housing shape is configured such that an inner surface area to volume ratio is lower than that of a comparative housing of rectangular cuboid shape, wherein the comparative housing has a shape which is consistent with a length, a height and a width of the housing.

13. A system of a vehicle and a pressure vessel according to claim 1.

14. The pressure vessel according to claim 1, wherein:

the housing is provided with a second support structure for each secondary peripheral circle, in the longitudinal cross-section of the housing, the second support structure connects the two further points of intersection, corresponding to a respective secondary peripheral circle and a respective primary peripheral circle, the second support structure is formed by an elongated plate, the elongated plate is connected to an inner surface of the housing along its longitudinal edges, the second support structure is provided with at least one through hole which extends from an inner face towards an outer face of the second support structure, wherein the at least one through hole comprises a plurality of through holes which are spaced at intervals of equal distance along the length of the second support structure, the housing shape is configured such that an inner surface area to volume ratio is lower than that of a comparative housing of rectangular cuboid shape, wherein the comparative housing has a shape which is consistent with a length, a height and a width of the housing.

15. The pressure vessel according to claim 1, wherein:

the housing is provided with a first support structure for each primary peripheral circle, in longitudinal cross-section of the housing, the first support structure connects the two points of intersection, corresponding to a respective primary peripheral circle and central circle, the first support structure is formed by an elongated plate, the elongated plate is connected to an inner surface of the housing along its longitudinal edges, the first support structure is provided with at least one through hole which extend from an inner face towards an outer face of the first support structure, wherein the at least one through hole comprises a plurality of through holes which are spaced at intervals of equal distance along the length of the first support structure, the housing is provided with a second support structure for each secondary peripheral circle, in the longitudinal cross-section of the housing, the second support structure connects the two further points of intersection, corresponding to a respective secondary peripheral circle and a respective primary peripheral circle, the second support structure is formed by an elongated plate, the elongated plate is connected to an inner surface of the housing along its longitudinal edges, the second support structure is provided with at least one through hole which extends from an inner face towards an outer face of the second support structure, wherein the at least one through hole comprises a plurality of through holes which are spaced at intervals of equal distance along the length of the second support structure, the housing shape is configured such that an inner surface area to volume ratio is lower than that of a comparative housing of rectangular cuboid shape, wherein the comparative housing has a shape which is consistent with a length, a height and a width of the housing.

16. A pressure vessel for storage of pressurized fluids, comprising a housing which extends along a longitudinal axis, wherein the housing defines an inner volume, wherein:

the shape of the housing, in longitudinal cross-section, is defined by the circumference of a set of circles, the set of circles comprises a central circle, with a center point which is defined by the longitudinal axis, and four primary peripheral circles each of which intersects with the central circle at two points, the primary peripheral circles are axially distributed on the central circle in opposing pairs, and wherein the pressure vessel further comprises a reinforcement which is provided around the housing, wherein:

the housing is shaped such that, in longitudinal cross-section, the housing fits within a square shape, the square shape has a width equal to a diameter of the central circle, the square shape has corners which are rounded such that each of these corners follows a curvature of a respective extremity of the set of circles, and the reinforcement is provided around the housing in such a manner that, in longitudinal cross-sectional, the reinforcement follows the square shape, with a gap between the reinforcement and the housing provided with a thermal insulation material.

* * * * *